United States Patent [19]

Re Baratelli

[11] 3,976,006

[45] Aug. 24, 1976

[54] PRINTING PRESS REGISTER GUIDES

[76] Inventor: Giuseppe Re Baratelli, Via Saronno 3, Milan, Italy, 20154

[22] Filed: Mar. 18, 1974

[21] Appl. No.: 451,815

[52] U.S. Cl. ..... 101/414; 101/316; 271/243

[51] Int. Cl.[2] ..... B41F 1/34

[58] Field of Search ..... 101/287, 316, 413, 414; 271/243; 339/128

[56] References Cited

UNITED STATES PATENTS

| | | | |
|---|---|---|---|
| 617,456 | 1/1899 | Babcock | 101/414 |
| 924,985 | 6/1909 | Hankins | 101/414 |
| 1,241,241 | 9/1917 | Nace | 101/414 |
| 2,057,281 | 10/1936 | Tassio | 101/414 |
| 2,208,048 | 7/1940 | Durup | 271/243 |
| 2,267,040 | 12/1941 | Parelius | 101/414 |
| 2,607,589 | 8/1952 | Wilburn | 101/287 |
| 3,168,039 | 2/1965 | Buttner | 101/316 |
| 3,560,908 | 2/1971 | Dell et al. | 339/128 |
| 3,654,382 | 4/1972 | Rubright | 339/128 |
| 3,671,363 | 6/1972 | Bruder | 271/243 |

FOREIGN PATENTS OR APPLICATIONS

| | | | |
|---|---|---|---|
| 808,839 | 7/1951 | Germany | 101/414 |

*Primary Examiner*—Edgar S. Burr
*Assistant Examiner*—William Pieprz

[57] ABSTRACT

A snap-on drop away register guide for use with a Heidelberg platen in a Heidelberg printing press includes a reciprocating spring biased plunger having transversely mounted thereon, for oscillating movement, a retractable guide plate. A camming arrangement exists between the guide plate and plunger which is operable upon rectilinear movement of the latter to effectuate the oscillating movement of the former between extended and retracted positions. A one-piece, snap-on raiser quickly changes the height of the lower paper margin and is provided with a vertical rib on one of two depending legs which cooperates with an offset on the drop away register guide to prevent improper mounting of the raiser on the drop away guide. An extension side guide for the Heidelberg platen includes an adjustment device for the lock screw thereof which not only permits the side guide to remain on the platen when not in use but also sideways movement relative to the platen.

13 Claims, 14 Drawing Figures

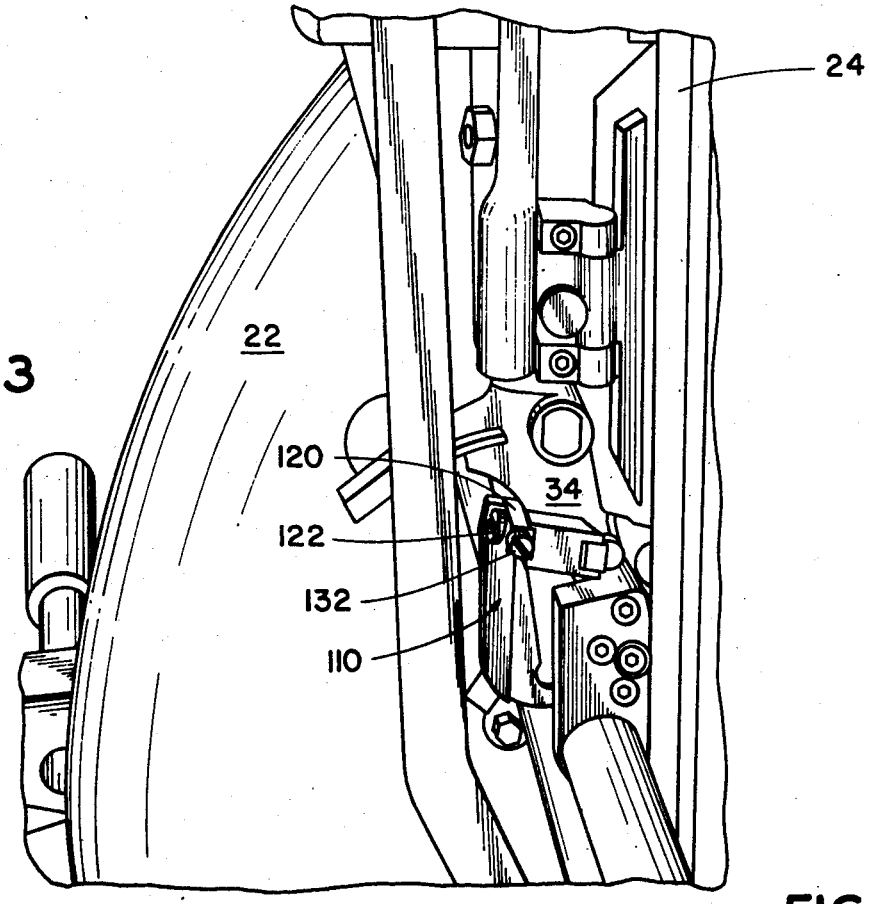
FIG.3
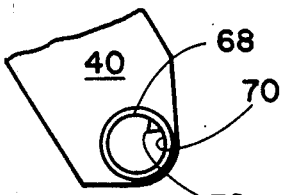
FIG.7
FIG.6
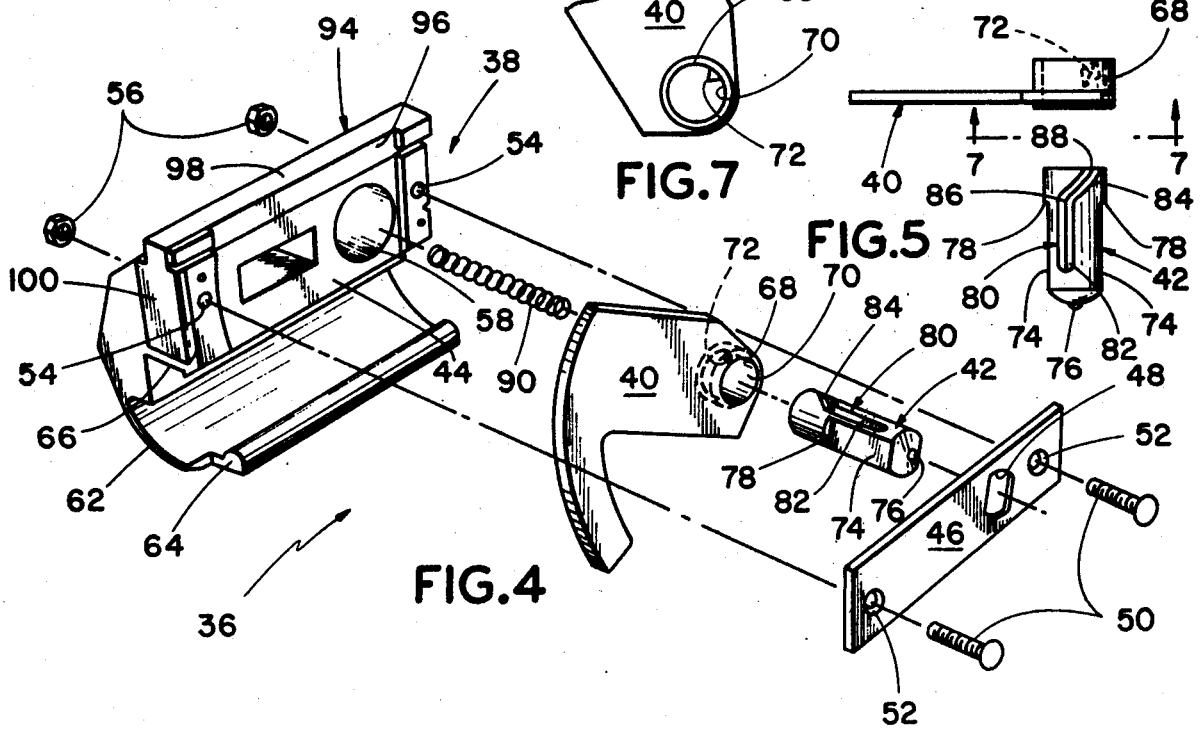
FIG.5
FIG.4

PRINTING PRESS REGISTER GUIDES

BACKGROUND OF THE INVENTION

1. Field of the Invention

The invention relates to guides which improve performance of a Heidelberg press, and, in particular, to: 1) a snap-on drop away register guide which converts rectilinear movement of a plunger to oscillating movement of a retractable guide plate by virtue of a camming action therebetween; 2) a one-piece, snap-on raiser which cooperates with the drop away guide to quickly change the margin size of the paper to be printed and which also prevents improper mounting, thereof on the drop away guide; and 3) an adjustment device for a lock screw in an extension side guide which permits fine lateral adjustment of the side guide relative to the platen and is not required to be removed when not in use.

2. Description of the Prior Art

Conventional drop away register guides used in conjunction with a Heidelberg press result in several disadvantages among which are: 1) their guide plates do not consistently retract during the printing operation, thereby resulting in smashed type; 2) they do not accurately maintain the position of paper sheets on the platen and slip out of position due to high press speed and with sheets of paper having certain size and/or weight; 3) the procedure for mounting and demounting them from a guide bar is time consuming due to the use of pins or screws; and 4) their guide plates during printing retract relatively prematurely, thereby do not provide for guidance of the paper during the period guidance is most desired.

In bleed printing, whenever it is desired to change the lower margin height on the paper, such as when printing business cards or other stocks of similar small size, it is common to substitute "nickel" guides for "brass" guides on the guide bar. This procedure, however, is a time consuming operation wherein unfastening and removal of the brass guides from the guide bar, and mounting and fastening of the nickel guides in the proper position are required.

Another conventional device which effects a change in margin height, is a raiser which is detachably mounted, by screws or the like, to the housing of a drop away register guide of the type described above. Difficulties arise with the use of these types of raisers because the mounting and demounting thereof are time consuming. Other devices used for adjusting margin height are rather complicated devices which include springs and pins. Thusly, as believed apparent, prior art techniques and devices for changing the height of the paper margin can be characterized as being relatively complicated, cumbersome and expensive.

Conventional side extension guides used in conjunction with a Heidelberg press are not laterally adjustable and therefore do not permit sideways registering without changing the form. Additionally, inconveniences arise in the use of conventional extension side guides because the register could be hampered on a normal size sheet that hits two side guides. Thusly, these side guides have to be removed at the end of a small paper run. This removal process requires expenditure of much time and attention. Furthermore, as is often the case, conventional side guides when removed drop and become lost in the platen well.

SUMMARY OF THE INVENTION

Accordingly, it is an object of the present invention to overcome the aforementioned disadvantages in connection with guide attachments used in cooperation with Heidelberg platens by providing simple, efficient, and effective guides which improve the overall printing operation of a Heidelberg press.

It is another object of the present invention to provide a detachably mountable drop register guide which insures proper retracting of the guide plate at the last possible moment prior to the printing operation, thereby eliminating time consuming conventional mounting and removal steps, possibility of damage to the type as the printing operation is performed, and guidance of the paper for as long as possible.

It is another object of the present invention to provide a raiser which enables the Heidelberg press to quickly, easily, and effectively change the height of the paper margin.

It is another object of the present invention to provide a raiser which cannot be improperly mounted.

It is another object of the present invention to provide an extension side guide, for use in the printing of small stock, which is enabled to be retained on the bracket associated with the Heidelberg platen during periods of non-use.

It is another object of the present invention to provide an extension side guide which is adjustable to permit fine sideways or lateral adjustment of the guide relative to a platen.

Certain of the aforementioned objects are accomplished by means of a drop away register guide which is capable of being snapped on the guide bar attached to a Heidelberg platen. The drop away guide includes a spring biased plunger mounted for rectilinear sliding movement relative to the guide housing. Transversely mounted on the plunger for oscillating movement relative thereto is a retractable guide plate. Cooperating camming means existing on both the plunger and the retractable guide plate are effective to convert rectilinear movement of the plunger to oscillating movement of the retractable guide plate, thereby moving the latter between extended and retracted positions.

In order to accomplish other of the aforementioned objects, a simple one-piece, snap-on raiser having a generally U-shape includes a main body portion and depending at opposite ends thereof two legs. Terminating at the lower portion of the legs are inwardly and oppositely disposed tongues which cooperate with respective lateral grooves formed on opposite ends of the drop away register guide housing so as to provide for an easy and effective detachable securement of the former to the latter. A rib located along one of the depending legs protrudes from a face of the main body portion by a dimension which exceeds the lateral dimension of an upper groove or channel formed on the drop away guide housing to receive the snap-on raiser. The housing of the drop away register guide is also provided with an offset which protrudes a small distance from an end surface of the housing. The offset and the rib cooperate to insure that the snap-on raiser will not be improperly mounted on the housing.

In order to permit both fine sideways registering or lateral movement of extension side guides as well as their retention on the platen in periods of non-use, an adjustment device is provided for the conventional locking screw thereof. The locking screw is slidably inserted through a non-threaded, preferably, oblong shaped slot formed in the guide head member and is removably secured to a bracket. The major axis of the slot is disposed so as to be transverse to the locking screw. Also extending in a direction transverse to the locking screw is an internally threaded bore dimensioned so as to accommodate an externally threaded adjustment screw. The adjustment screw has a forward tip which selectively contacts the locking screw so as to arrest sliding movement thereof. A spring is interposed between the guide head member and the head of the adjustment screw to prevent movement of the screw as a result of vibration. Whenever, it is decided to not use the extension side guide, the adjusment screw is manipulated so that the side guide is in the maximum out position, wherein the tip of the adjustment screw is at its inward limit of movement within the slot. At any time it is desired to adjust the lateral registering of the extension side guide, the adjustment screw need be rotated through only a partial revolution to remove the tip from contact with the locking screw. Since the oblong slot has its major axis transversely oriented to the locking screw with a dimension larger than the outer dimension of the shank of the locking screw the extension side guide member is permitted to move sideways relative to the bracket, thereby effecting the desired sideways registering.

The above as well as other objects, features, and advantages of the present invention will become apparent upon a reading of a detailed description of the preferred embodiment of the present invention when viewed in conjunction with the several views of the drawings, wherein like reference numberals indicate like parts:

BRIEF DESCRIPTION OF THE DRAWINGS

FIG. 3 is an enlarged partial perspective view of a Heidelberg press, taken substantially along line 3—3 of FIG. 1 looking in the direction of the arrows, illustrating the adjustable extention side guide embodying the principles of the present invention;

FIG. 4 is an exploded perspective view showing the components of the drop away register guide shown in FIGS. 1 and 2;

FIG. 5 is a plan view showing the plunger and slot of the drop away register guide of the present invention;

FIG. 6 is a plan view of the retractable guide plate of the present invention;

FIG. 7 is a side elevational view, taken substantially along line 7—7 of FIG. 6 looking in the direction of the arrows, showing a partial section of the retractable guide plate;

DESCRIPTION OF THE PREFERRED EMBODIMENT

Figure 1:
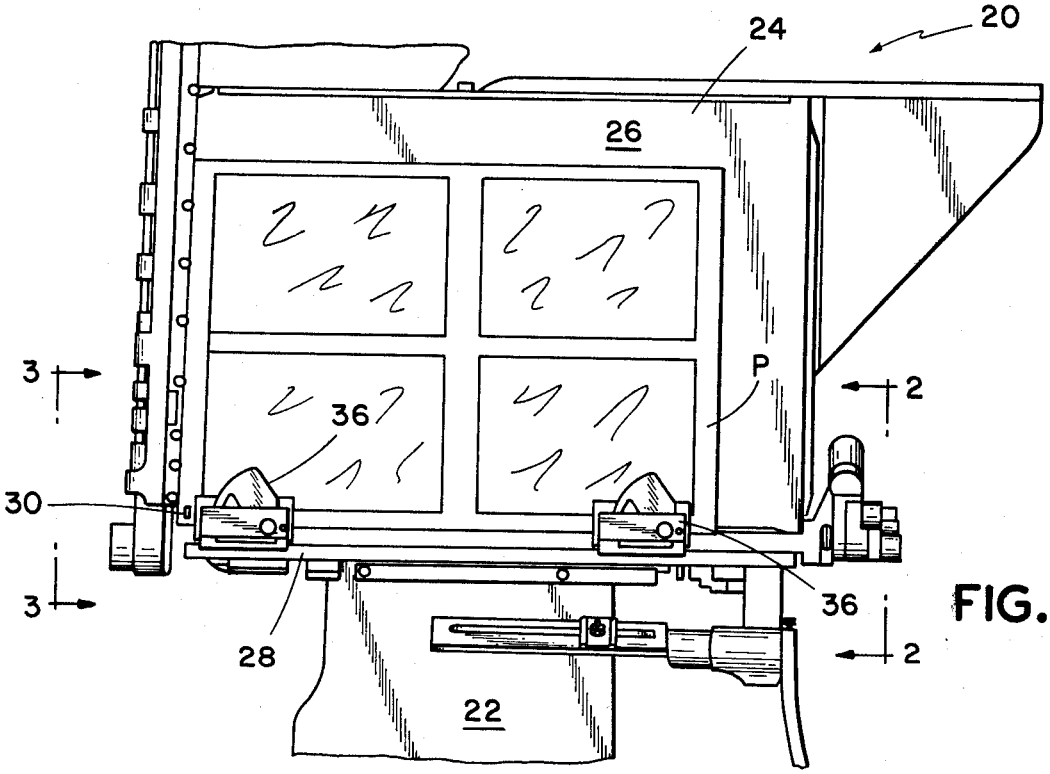
FIG. 1 is a front view showing the platen of a Heidelberg press with the drop away register guides, embodying the principles of the present invention, mounted on a guide bar.
Figure 2:
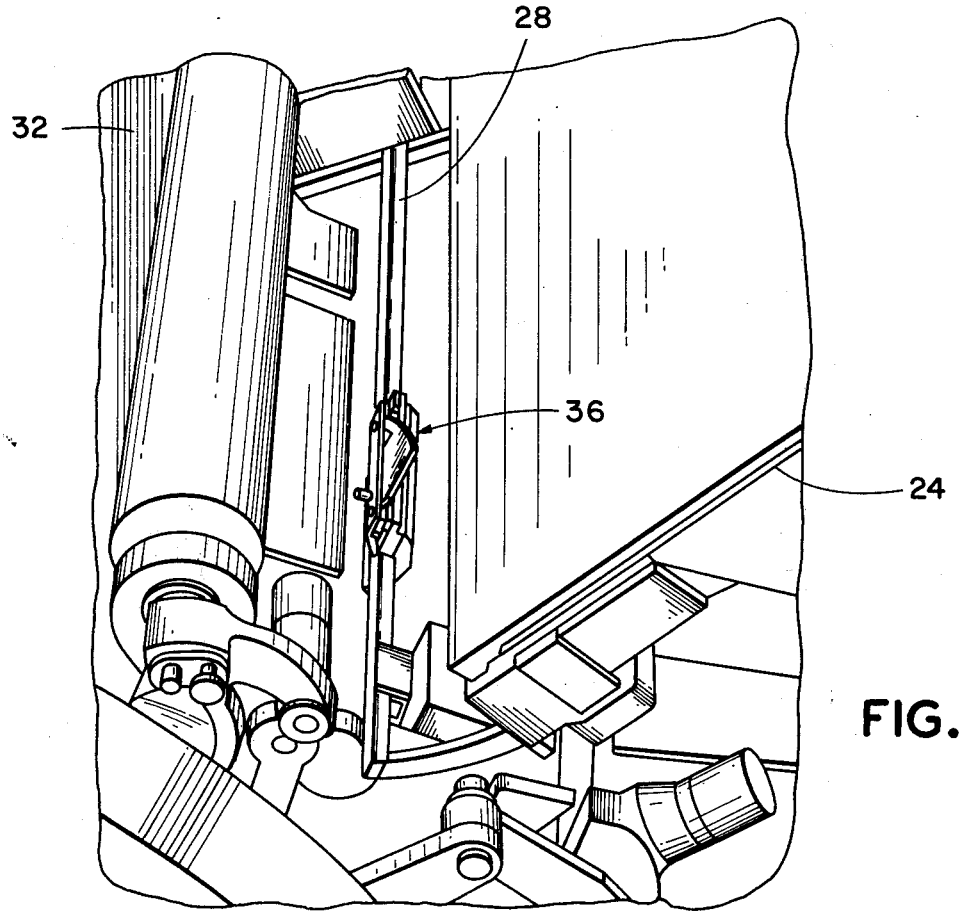
FIG. 2 is an enlarged partial perspective view of a Heidelberg press, taken substantially along line 2—2 of FIG. 1 looking in the direction of the arrows, illustrating another view of the drop away register guide of the present invention.

Referring to Figures of the drawings and, in particular, to FIGS. 1 to 3 there is generally disclosed a conventional Heidelberg press designated by reference numeral 20. It is to be understood, that only those portions of the press 20 required for a clear and complete understanding of the present invention will be described.

As perhaps best illustrated in FIG. 1, the press includes a selectively operable, movable press arm 22 and suitably affixed thereto a typical Heidelberg platen 24 with a generally planar surface 26. Guide bar 28 is attached to the press arm 22 and longitudinally extends beneath the lower end of the platen 24. Located at the lowermost lefthand corner of planar surface 26 is an opening 30. With reference to FIG. 2, the press 20 further includes a conventional press bed 32 against which a chase and metal type are supported. As best shown in FIG. 3, a bracket 34, the purpose of which is to be subsequently described, is connected to the press arm 22 on the opposite side of planar surface 26.

Now referring to FIG. 1 taken in conjunction with FIG. 4, there is illustrated as being associated with guide bar 28 a pair of drop-away register guides, embodying the principles of the present invention and each designated by reference numeral 36. In the particular embodiment to be described, the drop away guides are made of a suitable reinforced polymer. It is to be understood, of course, that any suitable material can be used. The drop away register guides 36 are, preferably, to be used in conjunction with Heidelberg press and serve to hold to the platen 24 a paper P to be printed such that the type print of the press 20 is able to print close to the bottom edge of the paper without contacting register guides 36. Each of the guides comprises, a housing 38, a retractable guide plate 40, and a reciprocating plunger 42. However, for the sake of simplicity only one of the register guides will be presently described.

The housing 38 includes a casing 44 and a cover plate 46. Cover plate 46 has a non-circular, preferably oblong-shaped, opening 48 and is detachably secured to the casing 44 by a pair of threaded bolts 50 extending through aligned openings 52 and 54 in the cover plate 46 and casing 44, respectively. Conventional nuts 56 are threadedly secured to the threaded end of the bolts 50 so as to detachably secure cover plate 46 to casing 44. A cylindrical recess 58 extends into the casing 44. Upwardly facing groove 60 (FIGS. 10 and 11) extends along the top of casing 44 for purposes to be subsequently described. The rearward end of the casing 44 has a generally convex configuration and depending therefrom is a generally curved member 62. Terminating at the end of the curved member 62 is an upstanding ridge 64 adapted to engage the bottom side of guide bar 28 (FIGS. 1 and 2). The portion of the casing 44 vertically above the ridge 64 is formed with a downwardly facing groove 66 and is adapted to fit over the top side of a guide bar 28. Both the downwardly facing groove 66 and ridge 64 cooperate to securely and detachably mount the register guide 36 to either the outside or inside of a bracket on the guide bar 28.

Referring to FIGS. 4, 6 and 7, the retractable guide plate 40 is shown as a generally flat member having located at one end thereof, a sleeve 68 extending from its opposite surfaces. In the assembled condition of the housing 38, one portion of the sleeve 68 is received within the cylindrical recess 58. Sleeve 68 also defines a bore 70 appropriately dimensioned to snugly fit over the plunger 42. The retractable guide plate 40 is transversely mounted on plunger 42 for substantially rotatable movement relative thereto and is prevented from appreciable axial movement by being positioned between the casing 44 and cover plate 46. Located within the bore 70 is a cam member 72 having a configuration of an inverted four-sided, preferably parallelogram base, pyramid (See FIG. 6.) It should be pointed out, however, that the opposing pairs of sides of the pyramid do not have the bases of each side equal in dimension but they should be substantially parallel to each other. As best illustrated in FIG. 7, the cam member 72 has a generally pointed shape.

Figure 8:
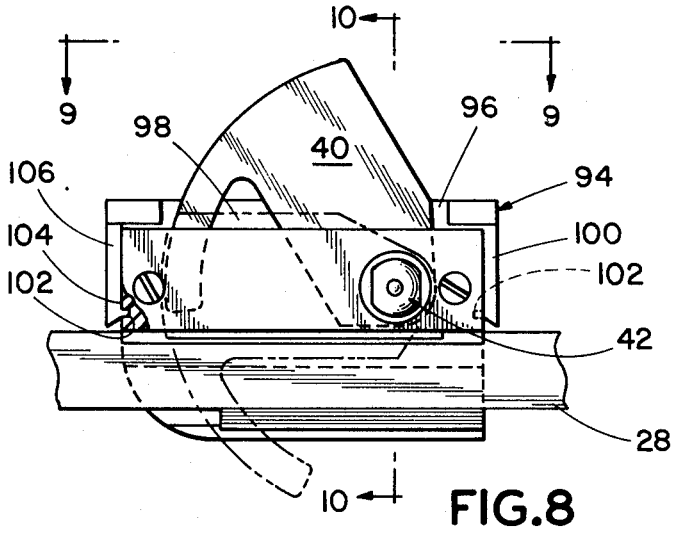
FIG. 8 is a side elevational view of the drop away register guide of the present invention.
Figure 9:
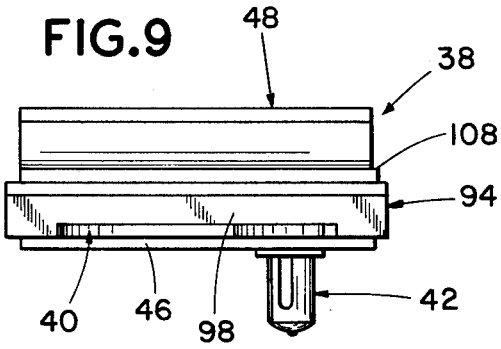
FIG. 9 is a plan view, taken substantially along the line 9—9 in FIG. 8 looking in the direction indicated by the arrows.

With reference to FIGS. 4, 5 and 8, the plunger 42 is shown as a generally longitudinally elongated element having generally flat side walls 74 adjacent a convex forward end terminating with a rounded nose 76. The nose 76 can be made integral with the plunger or, if desired, of a separate, desirably, wear resistant material. Shoulders 78 are formed at the rearward end of the sidewalls 74 and serve to prevent the plunger 42 from being expelled from the housing 38 by engaging the inner side of the cover plate 46. Non-circular opening 48 substantially conforms to the non-circular configuration of the forward end of the plunger 42. The purpose served by cooperating non-circular configurations of both the plunger 42 and opening 48 is to insure rectilinear movement of the plunger relative to the housing 38 by preventing relative rotation therebetween. The need for rectilinear movement will become readily apparent when a discussion of the camming operation of the present invention is presently described. As perhaps best illustrated in FIG. 5, a generally V-shaped cam slot 80 is formed on the plunger 42 and includes a generally linear segment 82 and a generally spiral or three dimensional curved segment 84 beginning at a juncture point 86 and terminating at end 88. The length of the spiral segment 84 determines the extent of oscillating movement of the retractable guide plate 40. Although, as shown in the figure the curved segment 84 is shown at a somewhat sharp inclination it is to be understood that this is for purposes of illustration and is not to be construed as a limitation. Additionally, as will subsequently become apparent, by the aforedescribed relationship of linear and curved segments, retraction of the guide plate will occur at the last possible moment prior to printing, thereby assuring that the paper P will be provided with guidance for as long as possible.

Figure 10:
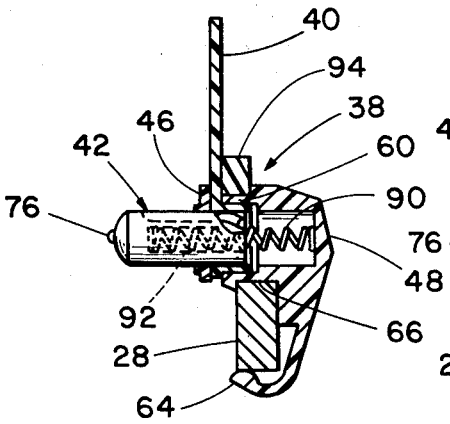
FIG. 10 is a sectional view taken substantially along the line 10—10 of FIG. 8 looking in the direction indicated by the arrows.
Figure 11:
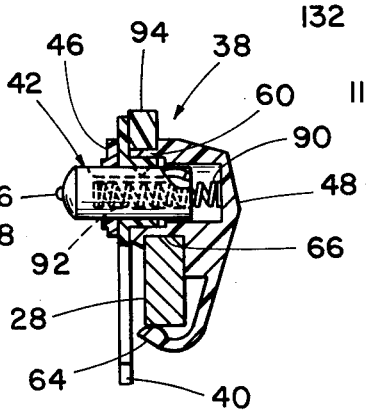
FIG. 11 is a sectional view corresponding generally to FIG. 10, but shows the movable components of the drop away register guide in a different operative position.
Figure 13:
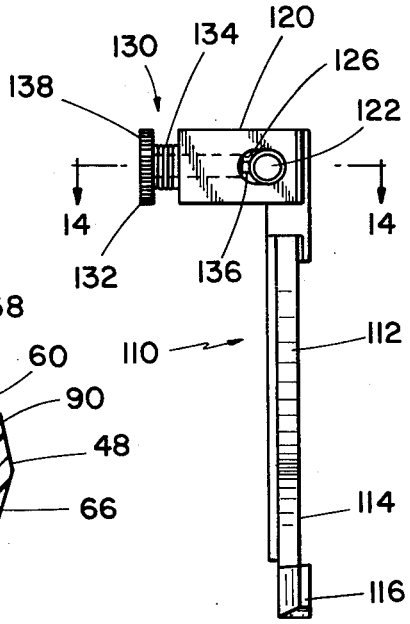
FIG. 13 is a front view of the extension side guide shown in FIG. 12.
Figure 12:
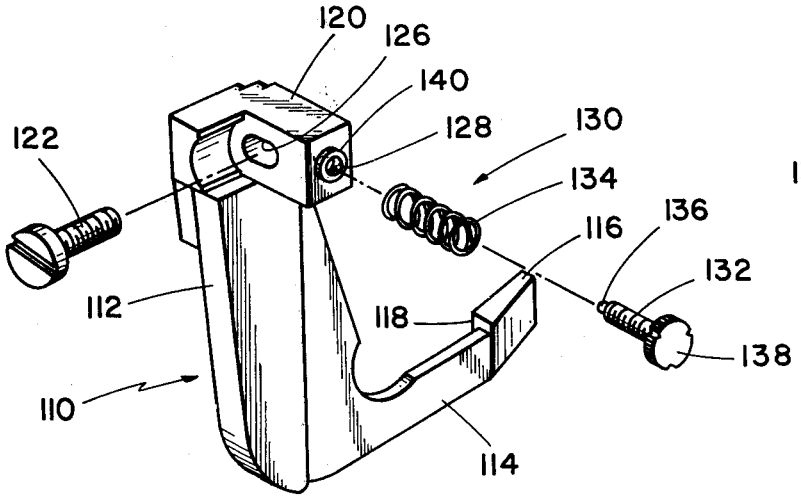
FIG. 12 is an exploded perspective view of the extension side guide shown in FIG. 3.

A conventional compression spring 90 is disposed within the cylindrical recess 58 having one end suitably mounted on an annular boss (not shown) and an opposite end fitted within plunger bore 92 (FIGS. 10 and 11). The cylindrical recess 58 is appropriately dimensioned to accommodate the reciprocatory movement of the plunger 42. The spring 90 normally serves to bias the plunger 42 outwardly from the housing 38.

Referring to FIGS. 1 and 2 the drop away register guide 36 is snapped on the guide bar 28 of the Heidelberg platen 24. The retractable guide plate 40, when in the extended position (FIG. 10) firmly holds the lower end of the paper P which is to be printed. With the use of the drop away register guides 36 of the present invention, only two such guides are needed thereby requiring fewer guides to properly position and hold the paper P.

Now with regards to the details of the operation of the drop away register guide 36, the operation of only one will be described, it being understood, of course, that both register guides perform in identical fashion. Reference is made to FIGS. 2, 4, 10 and 11. Turning now to FIG. 10 and as previously mentioned, the spring 90 biases the plunger 42 outwardly from the housing 38 until shoulders 78 contact the interior wall of cover plate 46 to prevent expulsion of plunger 42. When the plunger 42 is in this position, the cam member 72 is disposed adjacent end 88 of spiral segment 84 with only portions of a first pair of parallel opposed sides thereof engaging the spiral segment, and the retractable guide plate 40 is in the extended position. Upon movement of the press arm 22, and platen 24, as during the printing operation, the nose 76 is contacted by the press bed 32 thereby forcing plunger 42 to move inwardly and overcome the biassing force exerted by spring 90. As the plunger 42 slides inwardly it is prevented from being rotated by the cooperation of non-circular side walls 74 cooperating with non-circular opening 48. During the inward linear movement of plunger 42, the cam member 72 moves and is guided within spiral segment 84. As a result of the portions of the first pair of opposed parallel sides of the cam member contacting the side walls of spiral segment 84 a camming operation is effectuated which provides for the oscillatory movement of the retractable guide plate 40 relative to the linearly moving plunger 42. The oscillating movement is effective only when cam member 72 is within spiral segment 84. Thusly, as the cam member 72 passes the juncture point 86, the retractable guide plate 40 is moved to its retracted position (FIG. 11) and enters linear segment 82. In linear segment 82, portions of the remaining, or second, pair of opposed parallel sides of cam member 72 contact the side walls of the linear segment 82 and the first pair of sides are moved out of contact with the side walls. As aforementioned, by reason of the arrangement of the curved segment 84 and linear segment 82 retraction occurs at the last possible moment. The aforediscussed operation of the drop away register guide 36 effects an improved movement of retractable guide plate 40 to be retracted position, whereby there is no danger of the type contacting and being damaged by the retractable guide plate.

At the conclusion of printing, platen 24 moves away from the press bed 32, and spring 90 becomes active to urge plunger 42 once again outwardly from the housing 38 until shoulders 78 abut cover plate 46. During this returning movement of plunger 42, the cam member leaves linear segment 82 and as it passes juncture point 86 enters spiral segment 84. As mentioned above, when cam member 72 is within spiral segment 84 the caming operation commences and terminates when the plunger is no longer permitted to move linearly. During this transit of cam member 72 in spiral segment 84, the retractable guide plate 40 moves from its retracted position to its extended position. As would be expected, the second pair of opposed side walls of cam member 72 no longer contact the side walls of cam slot 80 as the cam member enters the spiral segment 84. In the spiral segment 84 portions of the first pair of the opposed side walls of cam member 72 contact the sidewalls of the cam slot 80.

Reference is made to FIGS. 4 and 8 to 11, where there is shown the one-piece, snap-on raiser 94, embodying the principles of the present invention. The snap-on raiser 94 eliminates the time consuming and cumbersome task of removing brass guides and replacing them with nickel guides and vice versa, so as to change the margin height on paper P. In order to accomplish a quick change in height the snap-on raiser 94 is inserted within an upwardly facing groove 60 (FIGS. 10 and 11) formed at the top of casing 44. The snap-on raiser 94 has a generally U-shaped configuration (FIG. 8). The front face 96 on the main body portion 98 of the raiser has two generally rectangular blocks extending adjacent the ends thereof. Depending from the main body 98 are leg members 100. Located at the bottom portion of these leg members 100 are inwardly and oppositely directed tongues 102. Both tongues 102 cooperate with lateral grooves 104 formed at the side of housing 38 when cover plate 46 is secured to casing 44, so as to thereby securely mount the raiser 94 on the drop away register guide 36. It should be emphasized that the legs 100 are somewhat resilient. In the embodiment being described the raiser is disclosed as being made of the same material as the drop away register guide 36. Of course, the materials do not have to be similar, but the raiser should possess some resiliency so as to facilitate the snap-on fit.

As viewed in FIG. 8, a vertical rib 106 extends outwardly from front face 96 along one of the legs 100 and has a dimension which exceeds the lateral dimension of upper groove 60. An offset 108 (FIG. 9) is provided on the side of the casing 44 adjacent the plunger 42. By virtue of the above arrangement if the rib 106 is to be inserted in the upper groove 60 when rib 106 is adjacent the offset 108, it would not be possible to press down and snap-on the raiser 94 due to the rib contacting the offset. The rib 106 can only be placed on that side of the casing 44 which does not have the offset. As is believed apparent, the raiser 94 can therefore be only placed on the casing 44 in one position. To snap-on the raiser 94, one will place the leg 100 having the rib 106 on the end of the casing 44 opposite the plunger 42 so that the tongue 102 engages the lateral groove 104 located on that side of the casing. The other leg 100 is then gently pulled so that it will extend over the opposite end of the casing 44. Thereafter, a gentle downward force is applied to the top of the raiser 94 to force the other tongue 102 into its respective lateral groove 104. When a clicking sound is heard the operator is assured that the raiser 94 is properly mounted. As aforementioned, the snap-on raiser is effective to rapidly change the margin from nickel height to brass height and vice versa. In practice this change in margin height normally amounts to about 2½ points.

Figure 14:
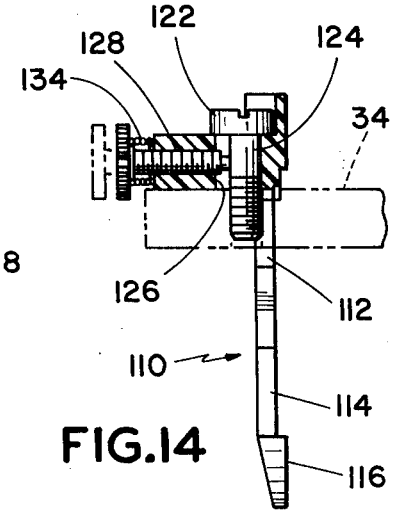
FIG. 14 is a vertical sectional view taken substantially along the line 14—14 of FIG. 13 looking in the direction indicated by the arrows.

As best viewed in FIGS. 3 and 12 to 14, the adjustable extension side guide 110 of the present invention is shown. As illustrated in the drawing, the side guide 110 is shown made of plastic, however, other suitable materials can also be utilized. In FIG. 3, the adjustable side guide is illustrated as being fastened to the bracket 34 formed behind the front face of the Heidelberg platen 24. The side guide 110 is extremely useful when printing small paper stock having narrow margins; such as business cards. The side guide has a generally L-shaped configuration including an upstanding arm 112 and angularly disposed thereto a laterally extending arm 114 terminating in a generally wedged-shaped guide member 116 which is effective to extend through an opening 30 (FIG. 1) in the Heidelberg platen 24. As more clearly indicated in FIG. 12 a shoulder 118 is provided between the lateral leg 114 and wedge-shaped member 116 and serves to provide a guide for the side of the paper P. During a printing operation the guide bar 28 moves upwardly through an angular distance equal to approximately 45° and the paper is moved against the wedge-shaped guide member 116 adjacent the shoulder 118. Attached to the top of the upstanding arm 112 and extending in a lateral direction is a head member 120. A conventional lock screw 122 cooperates with a threaded opening (not shown) in the bracket 34 thereby detachably securing the side guide 110 to the Heidelberg platen 24. As best shown in FIG. 14, the lock screw 122 has a non-threaded portion 124. The screw 122 extends through a generally non-threaded, preferably but not exclusively, oblong-shaped slot or opening 126. The slot 126 has a major axis which is transverse to the screw 122 and is dimensioned to permit lateral adjustment of the side guide 110 relative to the screw 122. A bore 128 has an axis which also extends generally transversely to the screw 122 and which is internally threaded to accommodate a portion of an adjustment device 130. The bore 128 inwardly terminates at the slot 126. The adjustment device 130 is comprised of adjustment screw 132 and a compression spring 134. The screw 132 has a forward tip 136 and a head portion 138. The adjustment screw 132 is fitted within the threaded bore 128 so that tip 136 contacts the non-threaded portion 124. The spring 134 is interposed between the inside of the head portion 138 and an annular boss 140 and, as is conventional, serves to prevent loosening of the screw by vibrations due to spring taking up any existing play between the adjustment screw 132 and threaded bore 128.

In the locking position, the tip 136 contacts the non-threaded portion 124 which also abuts a side of opening 126 and the above cooperation prevents any movement of the lock screw 122 relative to the side guide 110. In this position spring 134 is in a compressed condition. In this arrangement, the side extension guide 110 is the furthest or the maximum out it can be relative to the bracket 34, whereby the extension side guide will not be in use. As is believed apparent this provides an improvement in that the extension side guide 110 need not be removed whenever not in use. When it is desired to change the sideways register of the side guide 110, the adjustment screw 132 is appropriately rotated through a partial revolution as to remove the tip 136 from contact with the surface of the non-threaded portion 124. Consequently, due to the opening 126 being dimensioned for limited sideways adjustment of the side guide 110, the side guide can be moved relative to the bracket 34. In the embodiment being described the opening 126 is preferably dimensioned so as to permit the side guide 110 to be adjusted laterally by a distance equivalent to six points.

It is believed apparent from the foregoing descriptions of the structure and operation of the improved guide members used in conjunction with the Heidelberg platen they are effective to provide simple, inexpensive and effective guide members which improve the operation for the Heidelberg press.

While the particular embodiments of the present invention have been shown and described, it will be obvious to those skilled in the art that changes and modifications may be made without departing from this invention in its broader aspects and therefore, the aim in the appended claims is to cover all such changes and modifications as fall within the scope of this invention.

The invention claimed is:

1. For use on a printing press, a drop away guide having a housing, the improvement comprising: a spring biased elongated plunger member having a major axis extending from said housing for rectilinear sliding movement relative thereto, slot means on said plunger extending substantially the length thereof, a retractable member engageable with said plunger for movement in a plane perpendicular to the axis of said plunger between inward and outward positions relative to the housing, projection means on said retractable member cooperating with said slot means on said plunger, whereupon reciprocating sliding movement of said plunger, whereupon reciprocating sliding movement of said plunger effects a camming cooperation of said slot means on said plunger and said projection means on said retractable member thereby effecting an movement of said retractable member in a plane perpendicular to the axis of said plunger between the inward position and outward position relative to the housing.

2. In a drop away guide having a housing for use in a printing press, the improvement comprising: a biased elongated plunger member extending from said housing for rectilinear sliding movement into and out of the housing, slot means on said elongated plunger member, a retractable member mounted in the housing and being movable in a plane perpendicular to the rectilinear movement of said plunger member between an extended position and a retracted position relative to the housing and including cam means positioned thereon, said cam means cooperating with said slot means on said plunger member, whereby rectilinear reciprocating sliding movement of said elongated plunger member into said housing moves said retractable member from the extended position to the retracted position by virtue of a camming action effected between said cam means and said slot means.

3. The drop away guide in accordance with claim 2 further including a spring means engageable with said plunger member for biasing said elongated plunger member out of said housing.

4. The drop away guide in accordance with claim 2 wherein said housing includes a plate member having a non-circular opening therein and slidably fitted therein said elongated plunger member having a shape corresponding to said non-circular opening so as to prevent rotation of said elongated plunger member relative to said housing.

5. The drop away guide in accordance with claim 4 wherein said retractable member is transversely mounted on said plunger for oscillatory movement in a plane perpendicular to the movement of said plunger member and is so positioned that said cam means directly cooperates with said slot means to oscillate the same.

6. The drop away guide in accordance with claim 2 wherein said slot means has a V-shaped cross-section and comprises a linear segment portion parallel to the axis of said plunger and a spiral segment portion connected with said linear segment, whereupon when said slot means moves relative to said cam means and when said cam means is withing said spiral segment portion, said retractable member rotates to its retracted position.

7. The drop away guide in accordance with claim 2 wherein said housing includes a curved means adapted to engage a bottom surface of a guide bar and a downwardly facing groove formed in the lower side of said housing adapted to fit over a guide bar such that said downwardly facing groove and said curved means cooperate with each other and serve to detachably mount the drop away guide to the guide bar.

8. A snap-on raiser member, for use with a drop away register guide housing mounted to a printing press, the housing defining a pair of end walls adapted to receive and hold said raiser member and having an offset member extending outwardly from one of said end walls and along the length thereof of the housing, said raiser member including a main body portion, two depending resilient legs at opposite ends of said main body and extending perpendicularly thereto, inwardly directed and oppositely disposed tongues at the extremities of each of said legs such that upon attachment of said raiser member onto the housing, one of said tongues on one of said depending legs being engageable with one of said end walls of the housing and the other of said tongues on the other of said depending legs being engageable with the opposite one of said end walls of the drop away register guide housing for detachably securing said raiser member on the housing to maintain the margin height of the paper in the press.

9. The snap-on raiser in accordance with claim 8 further including a vertical rib integral to one of said depending legs and extending from one surface of said one leg along the length thereof, such that upon attachment of said raiser member onto the housing, said depending leg having said vertical rib thereon is engageable with said end wall opposite said end wall having said offset member extending outwardly therefrom and said other of said depending leg is engageable with said end wall having said offset extending therefrom for mounting the raiser member on the housing in a predetermined orientation.

10. In combination, a drop away register guide housing for mounting on a guide bar of a printing press platen, said housing defining a pair of end walls and having a groove extending across the upper surface of said housing, a snap-on raiser detachable mounted in said upper groove and having a generally U-shaped configuration including a main body portion adapted to engage said groove, and two depending resilient legs extending perpendicular thereto, and tongues formed on said legs, said tongues being inwardly directed and oppositely disposed relative to each other, a lateral groove formed horizontally across each of said housing end walls with each of said lateral grooves being adapted to receive and hold one of said tongues therein, a vertical rib mounted on and extending from one surface of one of said depending legs such that the width of said snap-on raiser and said vertical rib exceed the lateral dimension of said upper groove, and said housing further includes an offset member extending outwardly from one of said housing end walls, whereby when mounting said snap-on raiser on said housing, said dependent leg having said vertical rib thereon being engageable with said end wall opposite said end wall having said offset member extending therefrom and said other of said depending legs is engageable with said end wall having an offset member extending therefrom with each of said lateral grooves receiving and holding one of said tongues on said depending legs.

11. An extension side guide for use in connection with a bracket in a printing press and serving to register paper in the press including in combination a locking screw engageable with the bracket and being operable between a holding position and a locking position, a head member having an opening extending therethrough said opening being adapted to receive and permit said locking screw to be operable between said holding position and said locking position to lock said head member to the bracket in the printing press, said opening further having a dimension that accommodates limited lateral movement of said head member relative to said locking screw;

a threaded bore in said head member having an axis extending generally transversely to said locking screw;

an adjustment screw threadedly cooperating within the bore for longitudinal movement relative thereto, and a spring disposed between said adjustment screw and said head member, whereby said locking screw is inserted through said opening in said head member to hold said head member to the bracket on the printing press, the rotational movement of said adjustment screw provides for engagement with said locking screw when said locking screw is in said holding position and said head member is laterally moved and finely positioned on the bracket and said spring is compressed thereby preventing vibrational movement of said adjustment screw with respect to said head member, said locking screw being further rotated to said locking position to lock said head member to the bracket on the printing press.

12. The combination of claim 11, wherein the locking screw has a non-threaded portion and the adjustment screw has a forward tip that selectively contacts the non-threaded portion.

13. The combination of claim 12, wherein the opening in said head member has a generally oblong shape with a major axis generally transverse to said locking screw and the oblong opening is of a dimension which is greater than the dimension of the nonthreaded portion of said locking screw.

* * * * *

UNITED STATES PATENT OFFICE

CERTIFICATE OF CORRECTION

PATENT NO. : 3,976,006

DATED : August 24, 1976

INVENTOR(S) : Giuseppe Re Baratelli

It is certified that error appears in the above-identified patent and that said Letters Patent are hereby corrected as shown below:

Column 10, line 10

"withing" should be --within--

Signed and Sealed this

Second Day of November 1976

[SEAL]

*Attest:*

RUTH C. MASON
*Attesting Officer*

C. MARSHALL DANN
*Commissioner of Patents and Trademarks*